US007557495B2

(12) United States Patent
Tinwell

(10) Patent No.: US 7,557,495 B2
(45) Date of Patent: Jul. 7, 2009

(54) SPARK PLUG HAVING PRECIOUS METAL PAD ATTACHED TO GROUND ELECTRODE AND METHOD OF MAKING SAME

(76) Inventor: Paul Tinwell, 107 Chemin des Suanes Hautes, Quartier des Jaumillots, Fayence (FR) 83440

( * ) Notice: Subject to any disclaimer, the term of this patent is extended or adjusted under 35 U.S.C. 154(b) by 508 days.

(21) Appl. No.: 11/164,042

(22) Filed: Nov. 8, 2005

(65) Prior Publication Data

US 2007/0103046 A1 May 10, 2007

(51) Int. Cl.
*H01T 13/20* (2006.01)
*H01T 21/02* (2006.01)

(52) U.S. Cl. ..... 313/143; 313/141; 313/147; 445/7

(58) Field of Classification Search ..... None
See application file for complete search history.

(56) References Cited

U.S. PATENT DOCUMENTS

| | | | |
|---|---|---|---|
| 2,296,033 | A | 9/1942 | Heller |
| 4,514,657 | A | 4/1985 | Igashira et al. |
| 5,179,313 | A | 1/1993 | Eves et al. |
| 5,347,193 | A | 9/1994 | Oshima et al. |
| 5,395,273 | A | 3/1995 | Matsutani |
| 5,558,575 | A | 9/1996 | Chiu et al. |
| 5,811,915 | A | 9/1998 | Abe et al. |
| 5,977,695 | A | 11/1999 | Osamura et al. |
| 5,998,913 | A | 12/1999 | Matsutani |
| 6,078,129 | A | 6/2000 | Gotou et al. |
| 6,093,071 | A | 7/2000 | Osamura et al. |
| 6,132,277 | A | 10/2000 | Tribble et al. |
| 6,215,235 | B1 | 4/2001 | Osamura |
| 6,304,022 | B1 | 10/2001 | Matsutani |
| 6,533,628 | B1 | 3/2003 | Matsutani |
| 6,595,818 | B2 | 7/2003 | Uehara |
| 6,705,009 | B2 | 3/2004 | Niessner |
| 6,819,031 | B2 | 11/2004 | Hori |
| 6,827,620 | B1 | 12/2004 | Mizutani |
| 6,833,658 | B2 | 12/2004 | Niessner |
| 6,846,214 | B1 | 1/2005 | Gotou et al. |
| 7,045,939 | B2 | 5/2006 | Teramura et al. |
| 7,084,558 | B2 | 8/2006 | Teramura et al. |

(Continued)

FOREIGN PATENT DOCUMENTS

| | | |
|---|---|---|
| GB | 479540 | 2/1938 |

(Continued)

*Primary Examiner*—Sikha Roy
*Assistant Examiner*—Tracie Y Green
(74) *Attorney, Agent, or Firm*—Robert L. Stearns; Dickinson Wright PLLC

(57) ABSTRACT

A spark plug having a ground electrode with a precious metal pad welded to the ground electrode through a series of weld steps. The precious metal pad is a Pt-based pad which is attached to a side surface of the ground electrode via an attachment process that includes a resistance tack weld to initially secure the pad in place, a coining step to flatten the pad, a second resistance weld to form a permanent weld of the pad to the ground electrode, and a laser capping weld about the exposed periphery of the pad to seal the resistance weld. The laser capping weld comprises numerous overlapping weld spots that together form an annular weld bead located at or just below the discharge surface of the pad.

13 Claims, 3 Drawing Sheets

U.S. PATENT DOCUMENTS

| | | | | |
|---|---|---|---|---|
| 2004/0100178 | A1 | 5/2004 | Kanao et al. | |
| 2004/0129683 | A1 | 7/2004 | Torii et al. | |
| 2004/0189169 | A1 * | 9/2004 | Taniguchi et al. | 313/141 |
| 2005/0168121 | A1 * | 8/2005 | Tinwell | 313/141 |

FOREIGN PATENT DOCUMENTS

| | | |
|---|---|---|
| JP | 57-151183 | 9/1992 |
| JP | 06-045049 | 2/1994 |

* cited by examiner

SPARK PLUG HAVING PRECIOUS METAL PAD ATTACHED TO GROUND ELECTRODE AND METHOD OF MAKING SAME

TECHNICAL FIELD

This invention generally relates to a spark plug for use with an internal combustion engine, and more specifically, a spark plug having a precious metal pad attached to a side surface of a ground electrode.

BACKGROUND OF THE INVENTION

It is known in the art to prolong the life of spark plug electrodes by attaching various types of precious metal tip configurations to their firing ends. Some of the earliest examples of this technology are seen in U.S. Pat. No. 2,296,033 issued Sep. 15, 1942 to Heller, and in British Patent Specification No. 479,540 published in 1938 to Powell et al. The precious metal tips disclosed in these references are comprised of corrosion resistant materials, including platinum, platinum alloys such as platinum-rhodium, platinum-iridium and platinum-ruthenium, iridium, iridium alloys such as iridium-rhodium, as well as ruthenium, osmium and alloys thereof.

Furthermore, various methods, techniques and operating parameters for attaching precious metal tips have also been developed and utilized over the years. The particular materials or tip configurations used may affect which attachment technique or method is most affective. Several examples of these methods are disclosed in the following U.S. Pat. No. 5,558,575 issued to Chiu et al., U.S. Pat. No. 5,179,313 issued to Eves et al. and U.S. Pat. No. 6,304,022 issued to Matsutani.

SUMMARY OF THE INVENTION

According to one aspect of this invention, there is provided a spark plug that includes a shell, an insulator, a center wire assembly having a center electrode, a ground electrode having a side surface, and a precious metal pad having a sparking surface, a diameter and a thickness. The precious metal pad is attached to the ground electrode side surface with a weld bead that circumferentially surrounds the precious metal pad, and includes characteristics generally pertaining to its inner diameter (I), its outer diameter (J), and the depth (G) of overlapping weld spots.

According to another aspect of this invention, there is provided a spark plug that includes a ground electrode and a Pt-based precious metal pad, including characteristics generally pertaining to a ground electrode thickness (B) and width (C), and a precious metal pad diameter (E) and thickness (K), According to yet another aspect of this invention, there is provided a method of attaching a precious metal pad to a ground electrode side surface. This method includes first and second resistance welding steps, a coining step and a laser welding step.

Objects, features and advantages of this invention include, but are not limited to, providing an improved spark plug having, among other features, a precious metal pad for the ground electrode, and a combination of dimensional characteristics that promotes spark plug electrode durability.

BRIEF DESCRIPTION OF THE DRAWINGS

A preferred exemplary embodiment of the invention will hereinafter be described in conjunction with the appended drawings, wherein like designations denote like elements, and wherein.

DETAILED DESCRIPTION OF THE PREFERRED EMBODIMENT

Figure 1:
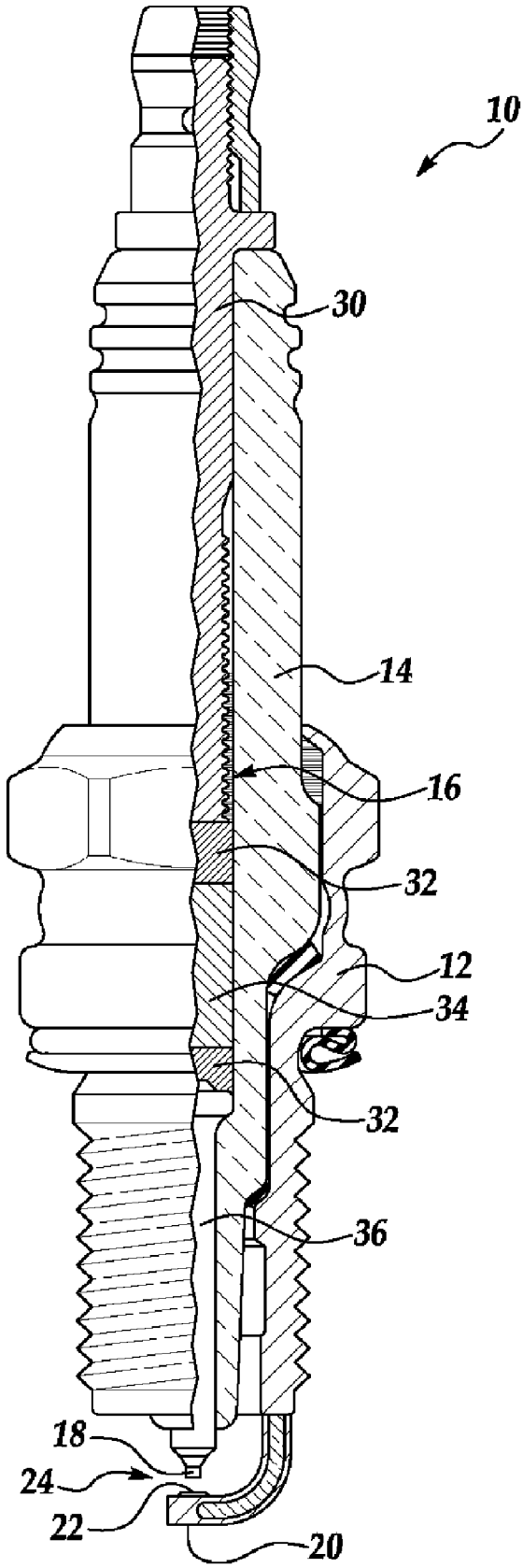
FIG. 1 shows a partial cutaway view of a spark plug having a precious metal pad attached to a ground electrode.

With reference to FIG. 1, there is shown an embodiment of a spark plug that utilizes precious metal components on both the center and ground electrode in order to minimize the effects of erosion and/or corrosion and thereby further extend the operational life of the plug. According to this particular embodiment, spark plug 10 generally includes a shell 12, an insulator 14, a center wire assembly 16, a precious metal tip 18, a ground electrode 20, and a precious metal pad 22.

As is commonly known in the art, shell 12 is preferably a metallic component having a hollow bore extending along its axial length such that it is generally symmetrical about its axis. Within that bore are a series of circumferential shoulders sized to support diametrically increased sections of the insulator. Insulator 14 is a generally cylindrical component with an elongated central bore, however, as its name suggests, the insulator is made from generally non-conducting materials. The lower axial end of insulator 14 forms a nose portion which preferably extends out of and beyond the lowermost portion of shell 12. The insulator axial bore is designed to receive center wire assembly 16, also referred to as the conductive insulator core, which delivers a high voltage ignition pulse from an ignition lead wire to a spark gap. Center wire assembly 16 preferably extends the entire axial length of the spark plug and generally includes a terminal electrode 30 for coupling with the ignition lead wire, one or more conductive and/or suppressive seals 32 and a resistive component 34 for reducing electromagnetic radiation such as radio frequency interference (RFI), and a center electrode 36 for carrying precious metal tip 18. Precious metal tip 18, which is preferably although not necessarily made from an Ir-based alloy such as IrRh, is attached to the lowermost or firing end of center electrode 36. The center wire assembly 16 shown here is simply an example of a combination of common center wire components, as numerous other combinations also exist.

Ground electrode 20 is both mechanically and electrically connected to the lower axial end of shell 12 and is generally bent in an L-shape configuration. On opposing surfaces of center and ground electrodes 36, 20, there respectively resides precious metal tip 18 and precious metal pad 22, which together form a spark gap 24. According to a preferred embodiment, spark gap 24 spans a dimension (A) that is between 0.5 mm-1.5 mm, inclusive. The precious metal components provide sparking or discharge surfaces that exhibit greater resistance to electrical erosion, oxidation, and chemical corrosion than do conventional electrode materials, thereby increasing the operational life of the spark plug. The preceding description of spark plug 10 is provided for purposes of illustration, as the attachment method disclosed herein may be utilized with one of any number of different spark plug embodiments, and is not limited to the particular embodiment described above.

Figure 2:
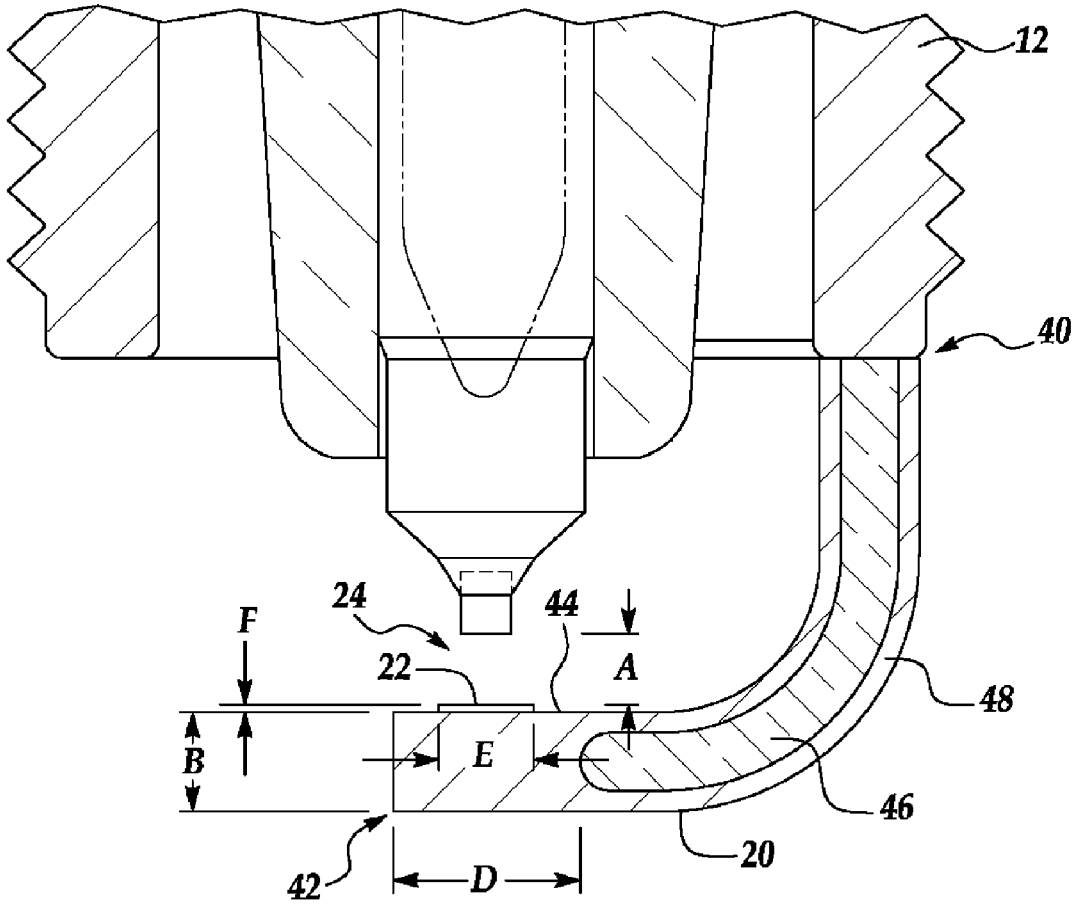
FIG. 2 shows an enlarged view of the lower axial end of the spark plug of FIG. 1.
Figure 4:
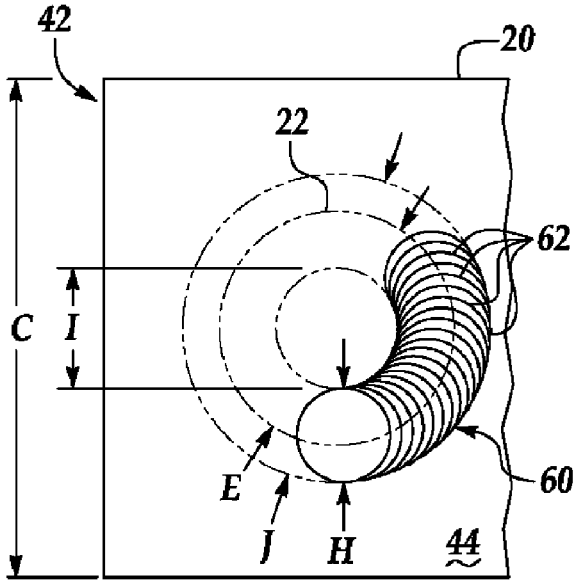
FIG. 4 shows an elevated view of a precious metal pad being attached to a ground electrode according to the attachment method shown in FIG. 3.
Figure 5:
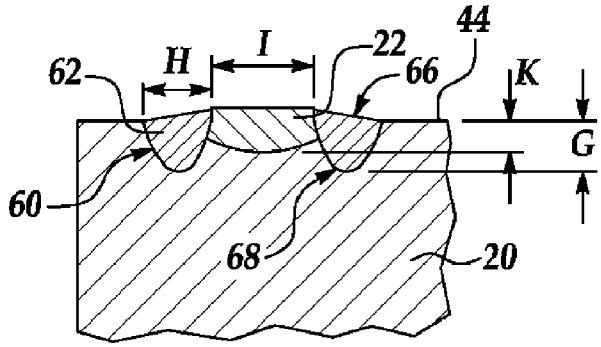
FIG. 5 shows a cutaway view of the precious metal pad and ground electrode of FIG. 4.

With specific reference to FIGS. 2, 4 and 5, ground electrode 20 both electrically conducts a high voltage ignition pulse, and thermally conducts heat away from the sparking surface near spark gap 24. The ground electrode is bent in a generally L-shaped configuration and preferably includes an attachment end 40 connected to a lower surface of shell 12, a free end 42, a side surface 44 that receives precious metal pad 22, a copper or other thermally conducting core 46, and a cladding material 48, which can be a nickel-based material such as Inconel 600/601. As seen in the drawings, copper core 46 does not extend the entire length of the ground electrode between attachment end 40 and free end 42; rather, it preferably stops near pad 22, either underneath it or at a position that is just short of it. Alternatively, the ground electrode could be provided without a copper or other type of core and could simply be made of an electrode material. Ground electrode 22 can have a circular, square, rectangular or other cross-sectional shape, and it can include a straight, squared-off free end 42 as shown or a tapered free end (not shown). It is desirable that ground electrode 20 have the following dimensional characteristics: an electrode thickness (B) that is between 0.75 mm-2.25 mm, an electrode width (C) that is between 2 mm-4 mm, and a distance (D) between the end of copper core 46 and free end 42 that is between 1 mm-5 mm, inclusive. It is even more preferable that dimension (B) be between 1 mm-1.75 mm, dimension (C) be between 2.25 mm-3.25 mm, and dimension (D) be between 2 mm-4 mm, inclusive. It is worth noting, all of the ranges just provided, as well as those provided elsewhere in this description, are inclusive of both the upper and lower limits.

Precious metal pad 22 is attached to side surface 44 of the ground electrode in the area of spark gap 24, such that it prolongs the life of the ground electrode. Preferably, the precious metal pad is made from platinum or from a platinum-based alloy, such as platinum-nickel (Pt-10Ni) or platinum-tungsten. In the case of the platinum-nickel alloy, it is preferable that it have Ni in the amount of 1-15% wt. Other precious metals, such as iridium, iridium-alloys, palladium-alloys, etc., may also be used. In the finished embodiment shown in FIG. 2, precious metal pad 22 is generally a flattened cylindrical pad that only protrudes from side surface 44 of the ground electrode by a small distance. The upper or exposed surface of precious metal pad 22 is the sparking or discharge surface that forms spark gap 24 with the lower or exposed surface of precious metal tip 18. As evidenced by the drawings, it is preferable that precious metal pad 22 have a larger diameter than that of the opposing precious metal tip 18. Furthermore, it is desirable that precious metal pad 22 have the following dimensional characteristics after it has been attached to ground electrode 20: a diameter (E) that is between 0.5 mm-2 mm, a protrusion distance (F) above side surface 44 that is between 0 mm-0.5 mm, and a precious metal pad thickness (K) that is between 0.025 mm-0.75 mm, inclusive. It is even more preferable that dimension (E) be between 1 mm-1.5 mm, that dimension (F) be between 0.05 mm-0.15 mm, and that dimension (K) be between 0.15 mm-0.35 mm, inclusive.

As appreciated by those skilled in the art, the dimensional characteristics of spark plug components, either by themselves or in combination with other components, can affect the performance, durability and manufacturability of the plug, as well as influencing those applications in which the spark plug assembly may be used, to name but a few of the implications resulting from the choice of dimensions. For example, those dimensions pertaining to the length and position of heat conducting cores, such as the distance (D) between copper core 46 and ground electrode free end 42, are capable of influencing the thermal conductivity properties of the spark plug near its firing end. The thermal conductivity of the spark plug firing end components, in turn, can affect the durability and performance of the spark plug, as previously discussed. Moreover, the diameter (E) of precious metal pad 22 and the distance (A) of spark gap 24 are just two examples of dimensions capable of influencing the intensity and nature of the spark created across the spark gap. Thus, selection of these dimensions often times is made with performance related issues in mind. Other considerations not mentioned herein also exist and play a part in the design of spark plug components, and more particularly, in the selection of spark plug component dimensions. Keeping this in mind, experimentation has found that certain dimensional combinations exhibit advantageous results.

One such dimensional combination that has yielded advantageous results is directed to a spark plug having a ground electrode with a thickness (B) between 0.75 mm-2.25 mm, a ground electrode width (C) between 2 mm-4 mm, a precious metal pad with a diameter (E) that is greater than the diameter of precious metal tip 18 and is between 0.5 mm-2 mm, and a precious metal pad thickness (K) between 0.025 mm-0.75 mm, inclusive. This combination provides an improvement to spark plug durability through good thermal management of the ground electrode and enhanced local 'wear' protection of the ground electrode, immediately adjacent the precious metal pad.

Figure 3:
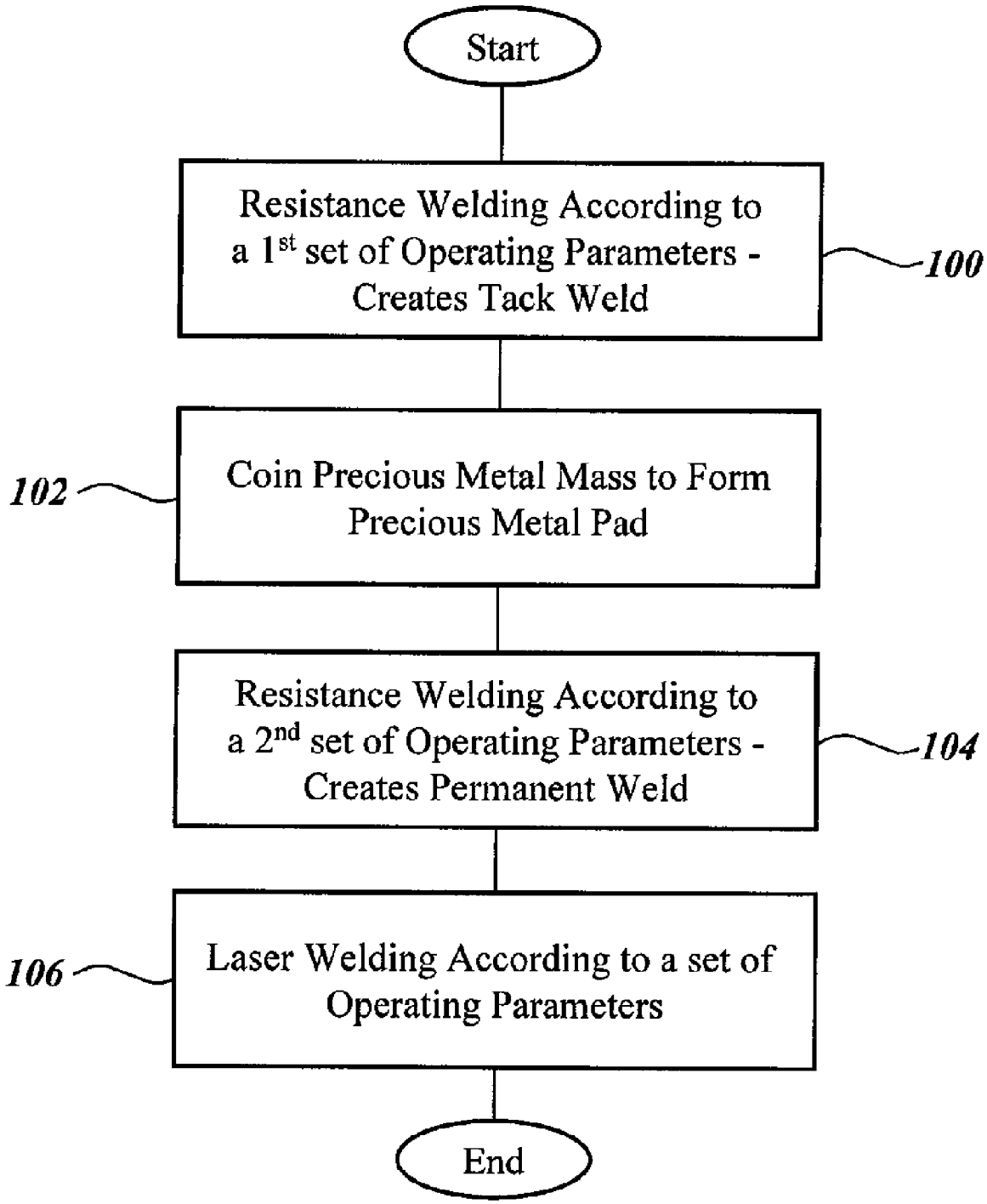
FIG. 3 is a flowchart showing the operational steps of an embodiment of the attachment method.

Turning now to FIG. 3, there is shown a flowchart demonstrating an embodiment of an attachment method which includes several steps for attaching precious metal pad 22 to side surface 44 of the ground electrode. Beginning with step 100, a mass of precious metal material is first resistance welded to side surface 44 of ground electrode 20 according to a first set of resistance welding parameters such that it forms a tack weld. A 'tack weld' is broadly defined as including all semi-permanent welds having enough strength to generally maintain the precious metal mass in place, but whose strength would typically be augmented by an additional weld. According to a preferred embodiment, a spherical mass of Pt-10Ni material having a diameter of approximately 0.75 mm is resistance welded to side surface 44 according to a first set of resistance weld parameters. Those parameters preferably include applying a force in the amount of 13 kgf-23 kgf, and applying an electrical current in the amount of 600 amps-1, 500 amps for 2-4 cycles (at 60 Hz, generally between 33-67 ms). The tack weld created during step 100 maintains the precious metal mass, which is now somewhat flattened and deformed due to the resistance welding process, in place throughout the remainder of the attachment process. Of course, it should be recognized that it is not necessary for the precious metal mass to have a spherical shape, as a number of other, non-spherical shapes may be used as well.

Next, step 102 coins the tack-welded precious metal mass such that precious metal pad 22 is formed. Again, there are a number of operating parameters that could be used to successfully perform the coining process including, but certainly not limited to, coining force. Instead of coining the precious metal mass according to a predetermined force, a coining force is chosen that produces a coined object of a desired shape and size. Use of excessive force should be avoided, as such force can deform the dimensions of ground electrode 20, including dimensions (B) and (C), instead of simply coining precious metal pad 22. The coining operation should result in a generally flat precious metal pad 22 where the surface is generally smooth and devoid of nicks. As previously stated, the coined precious metal pad should protrude above side surface 44 of the ground electrode by a distance (F).

Following the coining operation, a second resistance welding step 104 is preferably performed in order to further strengthen the bond between precious metal pad 22 and side surface 44 of the ground electrode. This second resistance welding step is performed according to a second set of operating parameters, which preferably include applying a force in the amount of 18 kgf-28 kgf, and applying an electrical current in the amount of 800 amps-1,650 amps for 2-5 cycles (at 60 Hz, generally between 33-83 ms). Whatever the particular operating parameters used, it is desirable that the second set of resistance welding parameters include a greater amount of force and/or electrical current than the first set of resistance welding parameters, thereby creating a permanent weld between precious metal pad 22 and ground electrode 20. Performance of steps 100-104 increases the density of the electrode material directly underneath precious metal pad 22, but should not cause any appreciable protrusion of the electrode material around the periphery of the pad. Once precious metal pad 22 has been resistance welded to side surface 44 according to the second set of resistance welding parameters, an inspection, either manual or automatic, can be performed to guard against excessive weld flash, off-center positioning of the precious metal pad, angled pad surface, ground electrode burrs, etc.

Next, laser welding step 106 uses one or more lasers to create a weld bead 60 that surrounds the perimeter of precious metal pad 22, thereby further strengthening the bond between the pad and the ground electrode. With specific reference to FIGS. 4 and 5, precious metal pad 22 is shown being laser welded to side surface 44 of the ground electrode. Weld bead 60 comprises a single bead of overlapping spot welds 62 which not only secures precious metal pad 22 to ground electrode 20, but also seals the interface between those two components so that the resistance weld will not oxidize or otherwise deteriorate. According to a preferred embodiment, a single pulsed Nd-YAG laser is operated according to a set of laser welding parameters, which include supplying the laser with energy in the amount of 0.75 J/pulse-1.5 J/pulse, at a pulse frequency of 60 Hz-100 Hz, such that 15-45 spot welds 62 are formed. Experimentation has shown that these laser welding parameters are particularly well suited for creating a weld bead 60 that is capable of retaining a precious metal pad to a ground electrode and sealing the area therebetween, particularly when the precious metal pad is comprised of a Pt-based alloy and the ground electrode is a Ni-based alloy. During laser emission, the laser beam is preferably maintained in a generally perpendicular fashion, with respect to side surface 44. In instances where undercutting the electrode is to be avoided, this generally perpendicular orientation should even be maintained where the sparking surface of precious metal pad 22 is not parallel with side surface 44, although a certain amount of angular misalignment is tolerable. It is worth noting, that while a single laser is used in the above-described preferred laser welding step, it is possible to alternatively use multiple lasers for creating weld bead 60.

Weld bead 60 is an annular or ring-shaped weld that concentrically surrounds precious metal pad 22 and is comprised of a number of individual spot welds 62. In a preferred embodiment, weld bead 60 forms a complete circle circumferentially surrounding the precious metal pad, however, it is possible for weld bead 60 to include a number of non-overlapping weld spots 62 that are angularly separated from each around the circumference of precious metal pad 22. Each weld spot 62 has a generally circular shaped weld pool when viewing down on to side surface 44 and pad 22 (FIG. 4) and it has a generally tapering shape in the axial extent (FIG. 5). The tapering shape causes an upper section 66 of spot weld 62 to have a greater width than a bottom section 68 of the spot weld, so that there is no undercutting of the spot weld. Put differently, spot weld 62 consistently gets narrower from an upper section 66 to a bottom section 68. Also, as is evident from FIG. 5, spot weld 62 should extend into ground electrode 20 by a depth (G) that exceeds depth (K) of precious metal pad 22; this helps ensure that a solid weld is formed and protects against the precious metal pad becoming inadvertently dislodged. According to a preferred embodiment, weld bead 60 includes the following dimensions: a weld spot diameter (H) between 0.3 mm-0.8 mm, a weld bead inner diameter (I) that is less than precious metal pad diameter (E) and is between 0.5 mm-1 mm, a weld bead outer diameter (J) that is greater than precious metal pad diameter (E) and is between 1.0 mm-2.5 mm, and a weld bead depth (G) that is greater than precious metal pad thickness (K) and is between 0.25 mm-0.75 mm, inclusive. It is even more preferable that dimension (H) be about 0.5 mm, that dimension (I) be between 0.65 mm-0.85 mm, and that dimension (J) be between 1.5 mm-2.0 mm, inclusive. Special attention should be paid to inner diameter (I), because if it is too small then the precious metal sparking surface area could be insufficient to establish a good, consistent spark.

As previously explained, the use of specific, experimentally-tested combinations of certain dimensions can affect the performance, durability and manufacturability of the spark plug. For example, different combinations of dimensions pertaining to the weld bead inner and outer diameters (I), (J), weld spot diameter (H), weld bead depth (G) and precious metal pad thickness (K) are capable of affecting the strength and durability of the bond which attaches precious metal pad 22 to the ground electrode 20 and are thereby capable of affecting the overall longevity of spark plug 10. One dimensional combination that has yielded advantageous results is directed to a spark plug having a precious metal pad with a diameter (E) between 0.5 mm-2 mm and a weld bead with an inner diameter (I) between 0.5 mm-1 mm and an outer diameter (J) between 1.0 mm-2.5 mm, inclusive. Another experimentally-tested dimensional combination involves a spark plug with a precious metal pad attached to a ground electrode with a weld bead having weld spots, where each of the weld spots has a diameter (H) between 0.3 mm-0.8 mm and a weld bead depth (G) between 0.25 mm-0.75 mm, inclusive. These dimensional combinations provide improvements to spark plug durability, and more particularly to the strength and robustness of the bond between the precious metal tip and the ground electrode, and are particularly well suited for the attachment of precious metal pads made from Pt-based alloys.

It is to be understood that the foregoing description is not a description of the invention itself, but of one or more preferred exemplary embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. For example, the second resistance weld of FIG. 3 can be performed along with the coining step in a single operation. Also, it is possible to utilize the attachment methods taught herein for attaching precious metal tip 18, particularly if it is a Pt- or Pt alloy-based tip, to the firing end of the center electrode; that is, the attachment method described above can be used to attach precious metal tips and/or pads to either center or ground electrodes. All such other embodiments, changes, and modifications are intended to come within the scope of the appended claims.

As used in this specification and appended claims, the terms "for example," "for instance," and "such as," and the verbs "comprising," "having," "including," and their other verb forms, when used in conjunction with a listing of one or more components or other items, are each to be construed as open-ended, meaning that that the listing is not to be considered as excluding other, additional components or items. Terms of degree such as "about" include not only the specified dimension or other number, but also variations that do not have a substantial impact on the characteristics or application of that to which the number relates. Other terms are to be construed using their broadest reasonable meaning unless they are used in a context that requires a different interpretation.

What is claimed is:

1. A spark plug for use with an internal combustion engine, comprising:

a shell having an axial bore;

an insulator having a central bore and being at least partially located within said shell axial bore;

a center wire assembly extending through said insulator central bore, said center wire assembly including a center electrode;

a ground electrode having an attachment end, a free end and a side surface, wherein said ground electrode extends from said attachment end at said shell to said free end such that a portion of said side surface adjacent said free end is positioned opposite a firing end of said center electrode;

a precious metal pad having a sparking surface, a diameter (E) and a thickness (K), wherein said precious metal pad is welded to said portion of said ground electrode side surface via a weld bead having the following characteristics: i) said weld bead generally circumferentially surrounds said precious metal pad, ii) said weld bead inner diameter (I) is less than said precious metal pad diameter (E), iii) said weld bead outer diameter (J) is greater than said precious metal pad diameter (E), iv) said weld bead includes a plurality of overlapping weld spots, and v) each of said weld spots has a weld bead depth (G) that is generally greater than said precious metal pad thickness (K).

2. The spark plug of claim 1, wherein said center electrode has a precious metal tip attached to said firing end, said precious metal tip comprising Ir or an Ir-based alloy and said precious metal pad comprising Pt or a Pt-based alloy.

3. The spark plug of claim 2, wherein said precious metal pad comprises a PtNi alloy having Ni in the amount 1-15% wt, inclusive.

4. The spark plug of claim 1, wherein said weld bead circumferentially surrounds said precious metal pad so that the interface between said precious metal pad and said ground electrode side surface is sealed.

5. The spark plug of claim 1, wherein each of said weld spots has a generally circular shape and tapers from an upper section to a lower section such that it has no undercuts.

6. The spark plug of claim 1, wherein attachment of said precious metal pad to said side surface increases the density of an electrode material directly underneath said precious metal pad, but does not cause any appreciable surface protrusion of said electrode material around the periphery of said precious metal pad.

7. The spark plug of claim 1, wherein said precious metal pad diameter (E) is between 0.5 mm-2 mm, said weld bead inner diameter (I) is between 0.5 mm-1 mm, and said weld bead outer diameter (J) is between 1.0 mm-2.5 mm, inclusive.

8. The spark plug of claim 1, wherein each of said weld spots has a diameter (H) between 0.3 mm-0.8 mm, and a weld bead depth (G) between 0.25 mm-0.75 mm, inclusive.

9. The spark plug of claim 1, wherein said weld bead comprises between 15-45 of said overlapping weld spots, inclusive.

10. The spark plug of claim 1, wherein said ground electrode further includes a thermally conductive core and a metal cladding, said core is spaced from said free end of said ground electrode by a distance (D) between 1 mm-5 mm, inclusive.

11. The spark plug of claim 1, wherein said precious metal pad extends beyond said side surface by a protrusion distance (F) between 0 mm-0.5 mm, inclusive.

12. The spark plug of claim 1, wherein said precious metal pad is attached to said ground electrode side surface according to a process that includes the following steps:

resistance welding a precious metal mass to said ground electrode, coining said precious metal mass such that a precious metal pad is formed, resistance welding said precious metal pad to said ground electrode, and laser welding aid precious metal pad to said ground electrode.

13. A spark plug for use with an internal combustion engine, comprising:

a shell having an axial bore;

an insulator having a central bore and being at least partially located within said shell axial bore;

a center wire assembly extending through said insulator central bore;

a ground electrode having a side surface, a thickness (B) and a width (C); and a Pt or Pt-based precious metal pad attached to said ground electrode side surface and having a diameter (E) and a thickness (K), wherein aid ground electrode and said precious metal pad preferably have the following characteristics: i) said ground electrode thickness (B) being between 0.75 mm-2.25 mm, ii) said ground electrode width (C) being between 2 mm-4 mm, iii) said precious metal pad diameter (E) being between 0.5 mm-2 mm, and iv) said precious metal pad thickness (K) being between 0.025 mm-0.75 mm, inclusive, and wherein said precious metal pad is attached to said ground electrode with a weld having a thickness which is greater than the thickness of said metal pad and wherein said weld extends into said ground electrode by a depth that exceeds the depth of said metal pad.

* * * * *